US006739958B2

(12) United States Patent
Chao et al.

(10) Patent No.: US 6,739,958 B2
(45) Date of Patent: May 25, 2004

(54) CARRIER HEAD WITH A VIBRATION REDUCTION FEATURE FOR A CHEMICAL MECHANICAL POLISHING SYSTEM

(75) Inventors: Sandy Shih-Hsun Chao, Campbell, CA (US); Andrew Nagengast, Sunnyvale, CA (US)

(73) Assignee: Applied Materials Inc., Santa Clara, CA (US)

( * ) Notice: Subject to any disclaimer, the term of this patent is extended or adjusted under 35 U.S.C. 154(b) by 80 days.

(21) Appl. No.: 10/102,083

(22) Filed: Mar. 19, 2002

(65) Prior Publication Data

US 2003/0181151 A1 Sep. 25, 2003

(51) Int. Cl.[7] ..... B24B 29/00
(52) U.S. Cl. ..... 451/288; 451/388
(58) Field of Search ..... 451/285, 286, 451/287, 288, 289, 388, 397, 41

(56) References Cited

U.S. PATENT DOCUMENTS

| | | | |
|---|---|---|---|
| 3,833,230 | A | 9/1974 | Noll |
| 4,217,766 | A | 8/1980 | Suckow |
| 4,373,991 | A | 2/1983 | Banks |

(List continued on next page.)

FOREIGN PATENT DOCUMENTS

| | | |
|---|---|---|
| EP | 0 156 746 | 10/1985 |
| EP | 0 747 167 A2 | 12/1996 |
| EP | 0 790 100 | 8/1997 |
| EP | 0 841 123 A1 | 5/1998 |
| GB | 2 307 342 | 5/1997 |
| JP | 62-145830 | 6/1987 |
| JP | 2-243263 | 9/1990 |
| JP | 6-125768 | 5/1994 |
| WO | 99/62672 | 12/1999 |

OTHER PUBLICATIONS

B. Holley and E. Mendel, *Mounting Method for Single–Side Polishing*, Mar. 1979, IBM Technical Disclosure Bulletin, vol. 21, No. 10.

*Primary Examiner*—Dung Van Nguyen
(74) *Attorney, Agent, or Firm*—Moser, Patterson & Sheridan

(57) ABSTRACT

Embodiments of the present invention are directed to a carrier head for positioning a substrate on a polishing surface. The carrier head includes a housing connectable to a drive shaft to rotate therewith; a base; a detachable plate removably mounted on top of the housing; a gimbal mechanism connecting the housing to the base to permit the base to move with respect to the housing such that the base remains substantially parallel to the polishing surface; and a flexible membrane defining a mounting surface for the substrate.

23 Claims, 6 Drawing Sheets

U.S. PATENT DOCUMENTS 4,519,168 A 5/1985 Cesna
4,954,142 A 9/1990 Carr et al.
5,081,795 A 1/1992 Tanaka et al.
5,205,082 A 4/1993 Shendon et al.
5,230,184 A 7/1993 Bukhman
5,423,558 A 6/1995 Koeth et al.
5,423,716 A 6/1995 Strasbaugh
5,441,444 A 8/1995 Nakajima
5,443,416 A 8/1995 Volodarsky et al.
5,449,316 A 9/1995 Strasbaugh
5,584,746 A 12/1996 Tanaka et al.
5,584,751 A 12/1996 Kobayashi et al.
5,605,488 A 2/1997 Ohashi et al.
5,624,299 A 4/1997 Shendon
5,635,083 A 6/1997 Breivogel et al.
5,643,061 A 7/1997 Jackson et al.
5,679,064 A 10/1997 Nishi et al.
5,695,392 A 12/1997 Kim
5,716,264 A 2/1998 Kimura et al.
5,733,182 A 3/1998 Muramatsu et al.
5,738,568 A 4/1998 Jurjevic et al.
5,738,574 A 4/1998 Tolles et al.
5,759,918 A 6/1998 Hoshizaki et al.
5,791,978 A * 8/1998 Cesna et al. ..... 451/388
5,795,215 A 8/1998 Guthrie et al.
5,851,140 A 12/1998 Barnes et al.
5,899,798 A 5/1999 Trojan et al.
5,916,015 A 6/1999 Natalicio
5,916,412 A 6/1999 Nakashiba et al.
5,944,590 A 8/1999 Isobe et al.
5,957,751 A 9/1999 Govzman et al.
5,993,302 A 11/1999 Chen et al.
6,007,252 A 12/1999 Thelen et al.
6,036,587 A * 3/2000 Tolles et al. ..... 451/288
6,044,818 A 4/2000 Decuir
6,080,050 A 6/2000 Chen et al.
6,102,777 A 8/2000 Duescher et al.
6,156,124 A 12/2000 Tobin
6,183,354 B1 2/2001 Zuniga et al.
6,190,238 B1 2/2001 Tanaka et al.
6,196,904 B1 3/2001 Matsuo et al.
6,244,946 B1 * 6/2001 Volodarsky ..... 451/307
6,277,009 B1 8/2001 Chen et al.
6,277,014 B1 8/2001 Chen et al.
6,386,955 B2 5/2002 Zuniga et al.

* cited by examiner

CARRIER HEAD WITH A VIBRATION REDUCTION FEATURE FOR A CHEMICAL MECHANICAL POLISHING SYSTEM

BACKGROUND OF THE INVENTION

1. Field of the Invention

The invention generally relates to a carrier head utilized during chemical mechanical polishing of substrates.

2. Description of the Related Art

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface presents a problem for the integrated circuit manufacturer. If the outer surface of the substrate is non-planar, then a photoresist layer placed thereon is also non-planar. A photoresist layer is typically patterned by a photolithographic apparatus that focuses a light image onto the photoresist. If the outer surface of the substrate is sufficiently non-planar, then the maximum height difference between the peaks and valleys of the outer surface may exceed the depth of focus of the imaging apparatus, and it will be impossible to properly focus the light image onto the outer substrate surface. Therefore, there is a need to periodically planarize the substrate surface to provide a substantially planar layer surface.

Chemical mechanical polishing (CMP) is one accepted method of planarization. This planarization method typically requires that the substrate be mounted to a carrier or polishing head. The exposed surface of the substrate is then placed against a rotating polishing pad. The carrier provides a controllable load, i.e., pressure, on the substrate to press it against the polishing pad. In addition, the carrier may rotate to provide additional motion between the substrate and polishing pad. A polishing slurry, including an abrasive and at least one chemically-reactive agent, may be distributed over the polishing pad to provide an abrasive chemical solution at the interface between the pad and substrate.

Typically, the carrier head is used to remove the substrate from the polishing pad after the polishing process has been completed. The substrate is vacuum-chucked to the underside of the carrier head. When the carrier head is retracted, the substrate is lifted off the polishing pad.

One problem that has been encountered in CMP is that during the course of polishing the wafer, vibrations of both high and low frequencies are produced, causing various problems associated with manufacturing efficiency and incremental increase in operating costs. High frequency vibrations (>250 Hz and <20 kHz) produced during polishing may present environmental, health and safety issues, while low frequency vibrations (<250 Hz) produced during polishing present may present reliability issues. For instance, the vibrations produced may cause gimbal screws to loosen, leading to slipped wafers. In addition, the polishing induced energy transmitted between the components in the carrier head may create resonance and amplification response that produce an inordinate amount of sound. The polishing induced energy may further cause relative bending movement within the polishing system.

A consideration in solving the problems associated with vibrations is developing a solution that is both cost efficient and ergonomically plausible, while still adhering to the established regulatory standards of the workplace.

Accordingly, a need exists for a chemical mechanical polishing apparatus that optimizes polishing throughput while minimizing vibrations during the course of polishing the wafer.

SUMMARY OF THE INVENTION

Embodiments of the present invention are generally directed to a carrier head for positioning a substrate on a polishing surface. In one embodiment, the carrier head includes: a housing connectable to a drive shaft to rotate therewith; a base; a detachable plate removably mounted on top of the housing; a gimbal mechanism connecting the housing to the base to permit the base to move with respect to the housing such that the base remains substantially parallel to the polishing surface; and a flexible membrane defining a mounting surface for the substrate.

Another embodiment of the present invention is directed to a carrier head for positioning a substrate on a polishing surface. The carrier head includes: a housing connectable to a drive shaft to rotate therewith; a base; a gimbal mechanism connecting the housing to the base to permit the base to move with respect to the housing such that the base remains substantially parallel to the polishing surface. The gimbal mechanism includes: a rod slidably disposed in a vertical passage in the housing; and a ring integrally connected to the rod. The ring defines a lower ring portion and an upper ring portion. The upper ring portion is made of a lighter material than the lower ring portion. The carrier head further includes a flexible membrane defining a mounting surface for the substrate.

Another embodiment of the present invention is directed to a carrier head for a chemical mechanical polishing apparatus. The apparatus includes: a housing connectable to a drive shaft to rotate therewith; a loading mechanism connecting the housing to a base to permit vertical movement of the base relative to the housing; and a detachable plate removably mounted on the housing.

Yet another embodiment of the present invention is directed to carrier head for a chemical mechanical polishing apparatus. The apparatus includes: a housing connectable to a drive shaft to rotate therewith; a loading mechanism connecting the housing to a base to permit vertical movement of the base relative to the housing; and a gimbal mechanism connecting the housing to the base to permit the base to move with respect to the housing such that the base remains substantially parallel to a polishing surface associated with the chemical mechanical polishing apparatus. The gimbal mechanism includes a dampening ring configured to dampen vibrations generated while polishing the substrate.

BRIEF DESCRIPTION OF THE DRAWINGS

So that the manner in which the recited embodiments of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

The present invention is directed to various embodiments of a carrier head for a chemical mechanical polishing apparatus. In one aspect, the carrier head includes a detachable plate mounted to a housing portion of the carrier head. More specifically, the detachable plate is mounted on top of a housing plate defined by the housing. The detachable plate provides the additional weight necessary for reducing the vibrations and noise generated while the substrate is being polished. In one embodiment, the detachable plate is manually removable such that no lifting equipment is required for removing the detachable plate. As a result of the additional weight provided by the detachable plate, the gimbal mechanism may be configured to be of a lesser weight. For instance, the upper portion of the gimbal ring may be made of a material lighter than the lower portion of the gimbal ring. In one embodiment, the upper portion of the gimbal ring is made of a material that reduces the energy created when the CMP system reaches resonance frequency. In one aspect of the invention, a dampening ring is placed in between the lower portion of the gimbal ring and the upper portion of the gimbal ring to dampen the vibrations generated during the polishing process.

Figure 1:
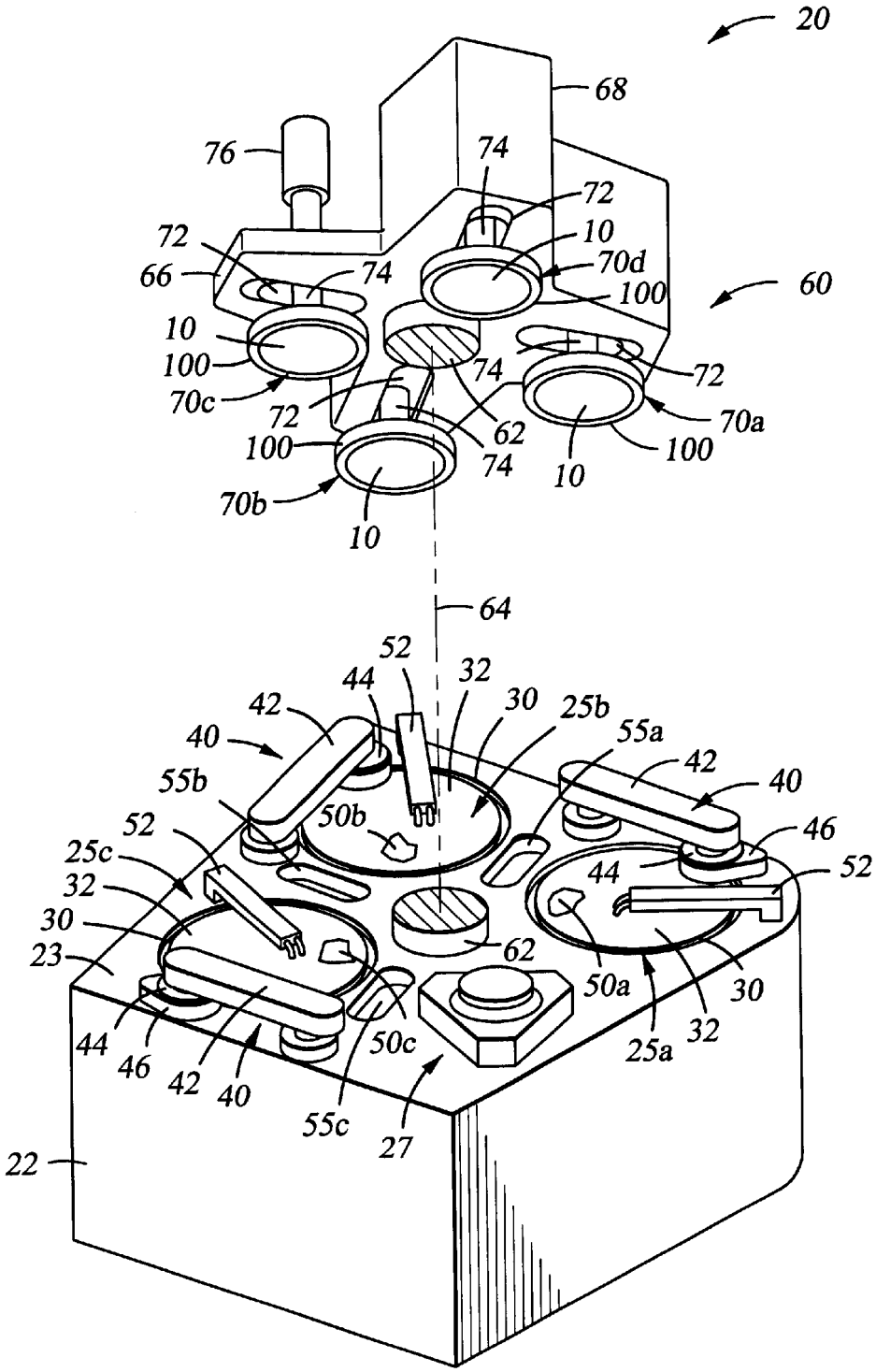
FIG. 1 is an exploded perspective view of a chemical mechanical polishing apparatus in accordance with an embodiment of the present invention.

Embodiments of the present invention may be used with a variety of chemical mechanical polishing (CMP) system, including the CMP system configured for polishing 200 mm substrates and the CMP apparatus configured for polishing 300 mm substrates, such as, the REFLEXION™ CMP system available from Applied Materials, Inc., of Santa Clara, Calif. Illustratively, an exploded perspective view of a chemical mechanical polishing apparatus 20 in accordance with an embodiment of the invention is illustrated in FIG. 1. The chemical mechanical polishing (CMP) apparatus 20 is configured to polish one or more substrates 10. A description of similar CMP systems may be found in U.S. Pat. No. 5,738,574 and U.S. Pat. No. 6,156,124, the entire disclosures of which are incorporated herein by reference.

According to the invention, the CMP apparatus 20 includes a lower machine base 22 with a table top 23 mounted on the CMP apparatus 20 and a removable upper outer cover (not shown). The table top 23 supports a series of polishing stations 25*a*, 25*b*, and 25*c*, and a transfer station 27. The transfer station 27 forms a generally square arrangement with the three polishing stations 25*a*, 25*b*, and 25*c*. The transfer station 27 performs multiple functions of receiving individual substrates 10 from a loading apparatus (not shown), washing the substrates, loading the substrates into the carrier heads, receiving the substrates from the carrier heads, washing the substrates again, and finally transferring the substrates back to the loading apparatus.

Each polishing station 25*a*–25*c* includes a rotatable platen 30 on which is placed a polishing pad 32. The platen 30 is preferably a rotatable aluminum or stainless steel plate connected by a stainless steel platen drive shaft (not shown) to a platen drive motor (also not shown). For most polishing processes, the drive motor rotates the platen 30 at about thirty to two-hundred revolutions per minute, although lower or higher rotational speeds may be used.

The polishing pad 32 may be a composite material with a roughened polishing surface. The polishing pad 32 may be attached to the platen 30 by a pressure-sensitive adhesive layer. The polishing pad 32 may have a fifty mil. thick hard upper layer and a fifty mil. thick softer lower layer. The upper layer is preferably a material composed of polyurethane mixed with other fillers. The lower layer is preferably a material composed of compressed felt fibers leached with urethane. A common two-layer polishing pad, with the upper layer composed of IC-1000 and the lower layer composed of SUBA-4, is available from Rodel, Inc., located in Newark, Del. (IC-1000 and SUBA-4 are product names of Rodel, Inc.).

Each polishing station 25*a*–25*c* may further include an associated pad conditioner apparatus 40. Each pad conditioner apparatus 40 has a rotatable arm 42 holding an independently rotating conditioner head 44 and an associated washing basin 46. The conditioner apparatus 40 maintains the condition of the polishing pad so that it will effectively polish any substrate pressed against it while it is rotating.

A slurry 50 containing a reactive agent (e.g., deionized water for oxide polishing), abrasive particles (e.g., silicon dioxide for oxide polishing) and a chemically-reactive catalyzer (e.g., potassium hydroxide for oxide polishing), is supplied to the surface of polishing pad 32 by a slurry supply tube 52. Sufficient slurry 50 is provided to cover and wet the entire polishing pad 32. Two or more intermediate washing stations 55*a* and 55*b* are positioned between neighboring polishing stations 25*a*, 25*b* and 25*c*. The washing stations 55*a* and 55*b* rinse the substrates 10 as they pass from one polishing station to another.

A rotatable multi-head carousel 60 is positioned above the lower machine base 22. The carousel 60 is supported by a center post 62 and is rotated thereon about a carousel axis 64 by a carousel motor assembly (not shown) located within the base 22. The center post 62 supports a carousel support plate 66 and a cover 68.

The multi-head carousel 60 includes four carrier head systems 70*a*, 70*b*, 70*c*, and 70*d*. Three of the carrier head systems receive and hold substrates and polish them by pressing them against the polishing pad 32 on the platen 30 of the polishing stations 25*a*–25*c*. One of the carrier head systems receives a substrate from and delivers the substrate to the transfer station 27. The four carrier head systems 70*a*–70*d* are mounted on the carousel support plate 66 at equal angular intervals about the carousel axis 64. The center post 62 allows the carousel motor to rotate the carousel support plate 66 and to orbit the carrier head systems 70*a*–70*d*, and the substrates attached thereto, about the carousel axis 64.

Each carrier head system 70*a*–70*d* includes a polishing or carrier head 100. Each carrier head 100 independently rotates about its own axis and independently laterally oscillates in a radial slot 72 formed in the carousel support plate 66. A carrier drive shaft 74 connects a carrier head rotation motor 76 to the carrier head 100 (shown by the removal of one-quarter of cover 68). Each head 100 therefore has one carrier drive shaft 74 and one motor 76.

Figure 2:
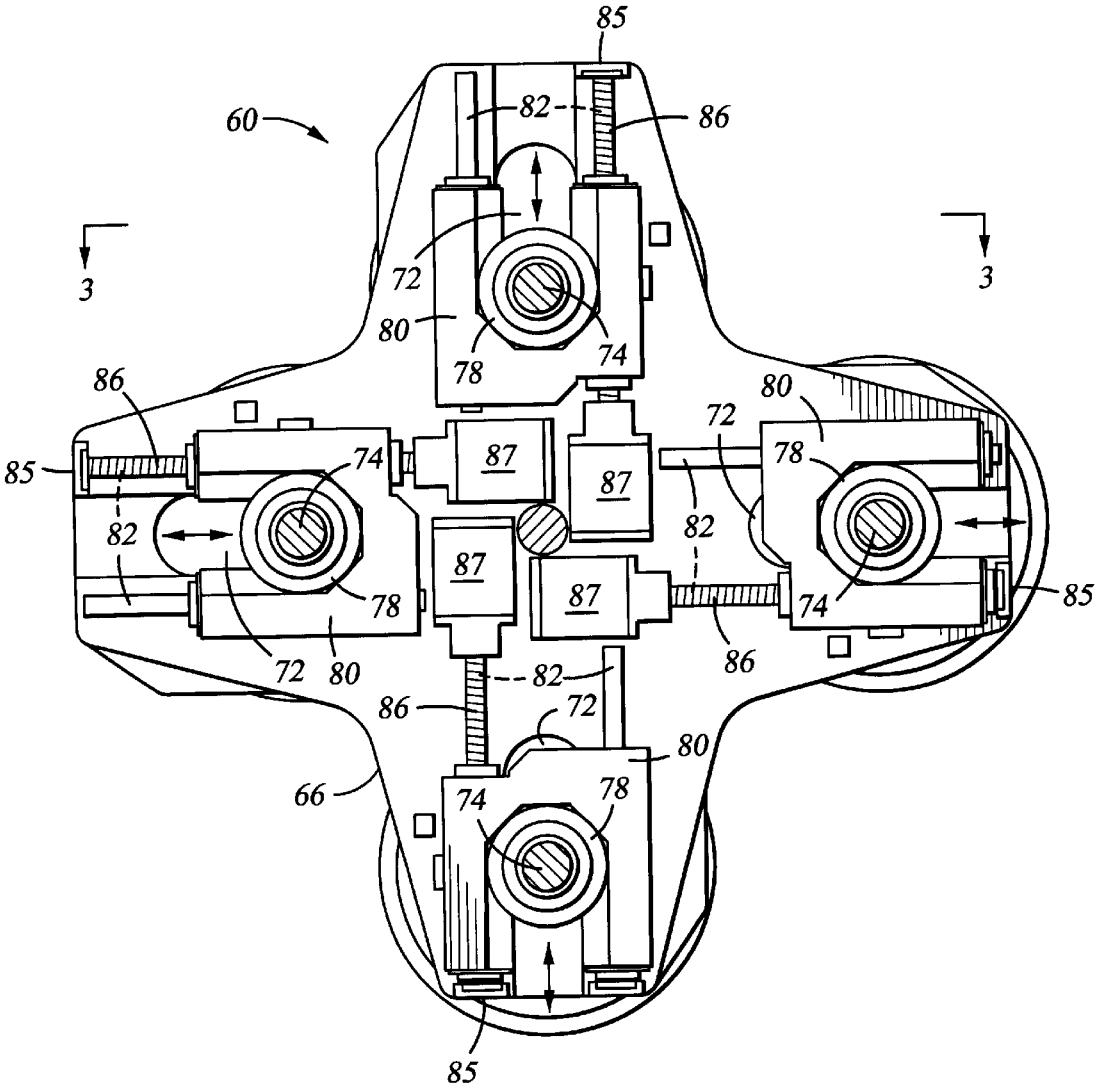
FIG. 2 is a schematic top view of a carousel, with the upper housing removed, in accordance with an embodiment of the present invention.

Referring now to FIG. 2, a schematic top view of the carousel 60 with the upper housing 68 removed in accordance with an embodiment of the invention is illustrated. As shown in FIG. 2, the carousel support plate 66 supports the four carrier head systems 70*a*–70*d*. The carousel support plate 66 includes four radial slots 72, generally extending radially and oriented 90 degree apart. The four radial slots 72 may either be close-ended (as shown) or open-ended. The top of support plate 66 supports four slotted carrier head support slides 80. Each slide 80 aligns along one of the radial slots 72 and moves freely along a radial path with respect to the carousel support plate 66. Two linear bearing assemblies bracket each radial slot 72 to support each slide 80.

Figure 3:
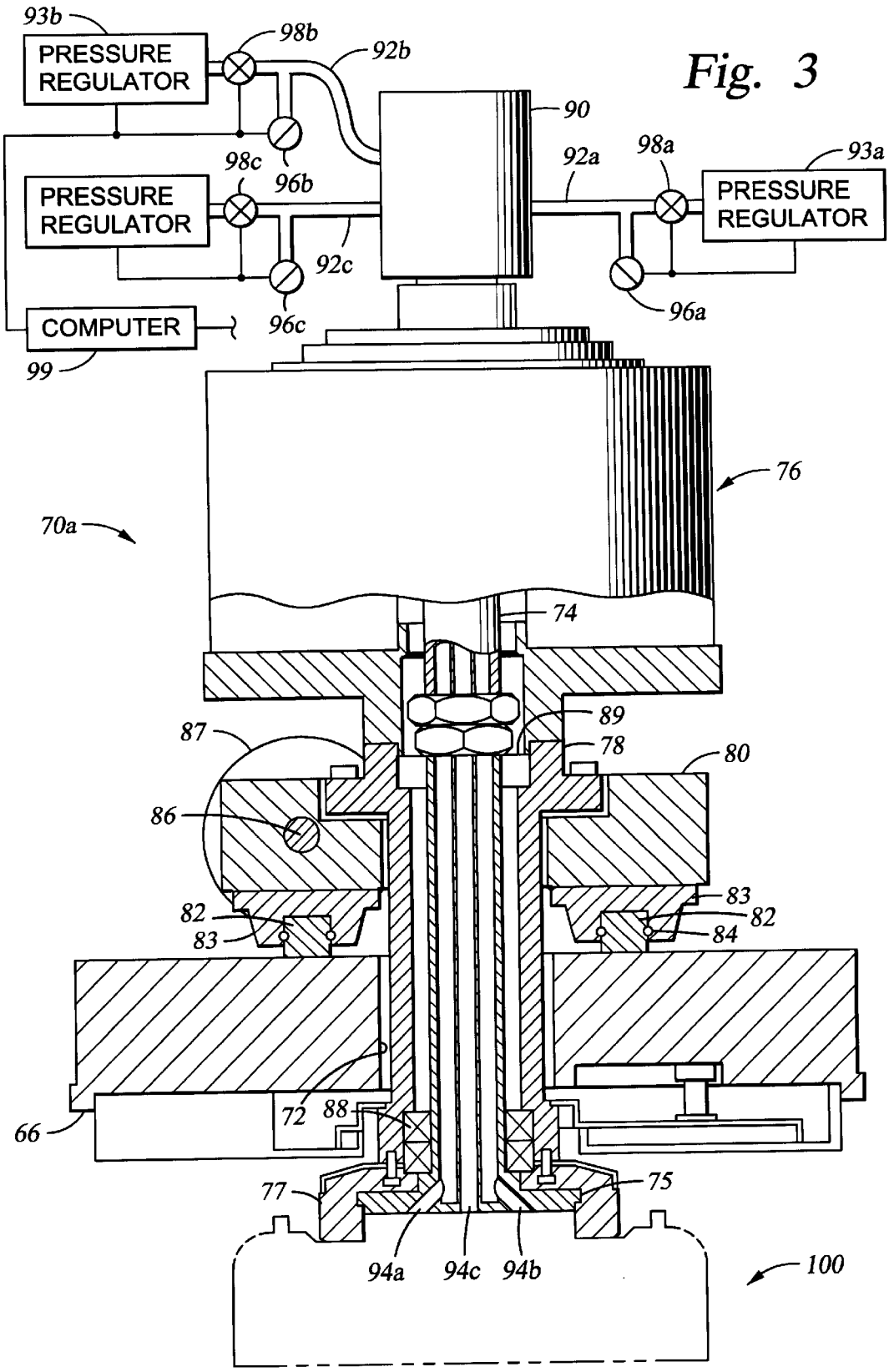
FIG. 3 is partially a cross-sectional view of the carousel of FIG. 2 along line 3—3, and partially a schematic diagram of the pressure regulators used by the CMP apparatus, in accordance with an embodiment of the present invention.

As shown in FIGS. 2 and 3, each linear bearing assembly includes a rail 82 fixed to the carousel support plate 66, and two hands 83 (only one of which is illustrated in FIG. 3) fixed to the slide 80 to grasp the rail 82. Two bearings 84 separate each hand 83 from the rail 82 to provide free and smooth movement therebetween. Thus, the linear bearing assemblies permit the slides 80 to move freely along the radial slots 72.

A bearing stop 85 anchored to the outer end of one of the rails 82 prevents the slide 80 from accidentally coming off the end of the rails. One of the arms of each slide 80 contains an unillustrated threaded receiving cavity or nut fixed to the slide near its distal end. The threaded cavity or nut receives a worm-gear lead screw 86 driven by a slide radial oscillator motor 87 mounted on the carousel support plate 66. When the motor 87 turns the lead screw 86, the slide 80 moves radially. The four motors 87 are independently operable to independently move the four slides along the radial slots 72 in the carousel support plate 66.

A carrier head assembly or system, each including a carrier head 100, a carrier drive shaft 74, a carrier motor 76, and a surrounding non-rotating shaft housing 78, is fixed to each of the four slides. The drive shaft housing 78 holds the drive shaft 74 by paired sets of lower ring bearings 88 and a set of upper ring bearings 89.

A rotary coupling 90 at the top of drive motor 76 couples three or more fluid lines 92*a*, 92*b* and 92*c* to three or more channels 94*a*, 94*b* and 94*c*, respectively, in the drive shaft 74. Three vacuum or pressure sources, such as pumps, venturis or pressure regulators (hereinafter collectively referred to simply as "pumps") 93*a*, 93*b* and 93*c* may be connected to fluid lines 92*a*, 92*b* and 92*c*, respectively. Three pressure sensors or gauges 96*a*, 96*b* and 96*c* may be connected to fluid lines 92*a*, 92*b* and 92*c*, respectively. Controllable valves 98*a*, 98*b* and 98*c* may be connected across the fluid lines between pressure gauges 96*a*, 96*b* and 96*c* and pumps 93*a*, 93*b* and 93*c*, respectively. Pumps 93*a*–93*c*, pressure gauges 96*a*–96*c* and valves 98*a*–98*c* may be appropriately connected to a general-purpose digital computer 99. The computer 99 may operate pumps 93*a*–93*c*, as described in more detail below, to pneumatically power the carrier head 100 and to vacuum-chuck a substrate to the bottom of the carrier head 100. In addition, the computer 99 may operate the valves 98*a*–98*c* and monitor the pressure gauges 96*a*–96*c* to sense the presence of the substrate in the carrier head.

During actual polishing, three of the carrier heads, e.g., those of carrier head systems 70*a*–70*c*, are positioned at and above respective polishing stations 25*a*–25*c*. The carrier head 100 lowers a substrate 10 into contact with the polishing pad 32, and the slurry 50 acts as the media for chemical mechanical polishing of the substrate or wafer.

The substrate 10 is typically subjected to multiple polishing steps, including a main polishing step and a final polishing step. For the main polishing step, usually performed at station 25*a*, the carrier head 100 may apply a force of approximately four to ten pounds per square inch (psi) to the substrate 10. At subsequent stations, the carrier head 100 may apply more or less force. For example, for a final polishing step, usually performed at station 25*c*, the carrier head 100 may apply a force of about three psi. The carrier motor 76 rotates the carrier head 100 at about thirty to two-hundred revolutions per minute. The platen 30 and the carrier head 100 may rotate at substantially the same rate.

Generally, the carrier head 100 holds the substrate 10 against the polishing pad 32 and evenly distributes a force across the back surface of the substrate 10. The carrier head 100 also transfers the torque from the drive shaft to the substrate 10 and ensures that the substrate 10 does not slip from beneath the carrier head 100 during polishing.

Figure 4:
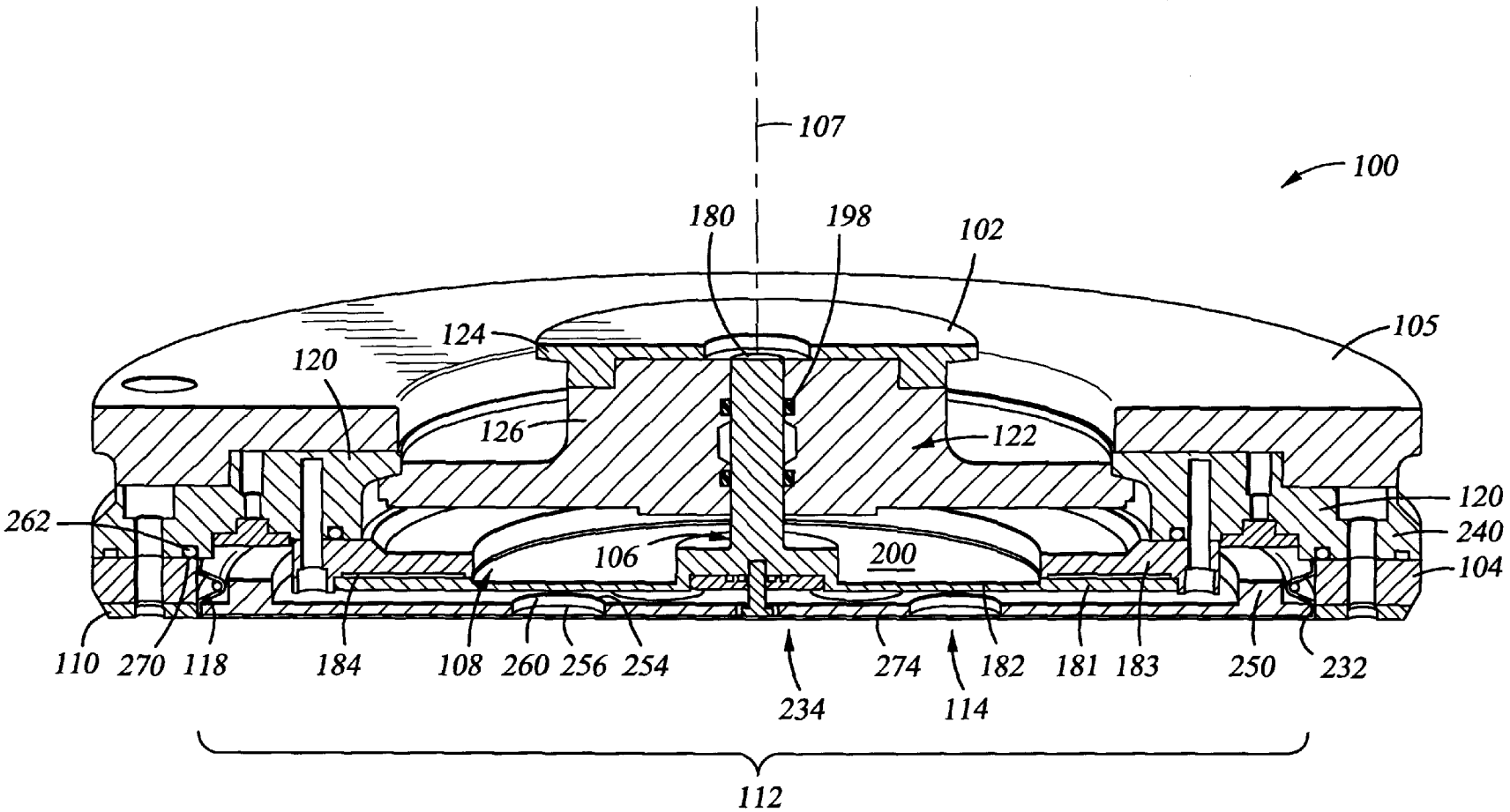
FIG. 4 is a side perspective view of a carrier head with a detachable plate and a gimbal mechanism in accordance with an embodiment of the present invention.

Referring now to FIG. 4, a side perspective view of the carrier head 100 in accordance with an embodiment of the invention is illustrated. The carrier head 100 includes a housing 102, a detachable plate 105, a base 104, a gimbal mechanism 106, a loading mechanism 108, a retaining ring 110, and a substrate backing assembly 112. A more detailed description of a similar carrier head may be found in U.S. Pat. No. 5,957,751, the entire disclosure of which is hereby incorporated by reference.

The housing 102 is connected to the drive shaft 74 to rotate therewith about an axis of rotation 107, which is substantially perpendicular to the surface of the polishing pad 32. The housing 102 is generally circular in shape to correspond to the circular configuration of the substrate 10 to be polished. The housing 102 includes an annular housing plate 120. A detachable plate 105 is mounted on top of the housing plate 120 to reduce the vibrations associated with polishing by increasing the inertia of the carrier head 100. The detachable plate 105 has a generally ring-shaped body. The weight of the detachable plate 105 may vary in accordance to the carrier head 100 or the substrate 10. In one embodiment, the detachable plate 105 weighs about 25 pounds. The additional weight provided by the detachable plate 105 allows a wider process operating range for key polishing parameters, such as, head/platen rotation speed, down force, and slurry flow rate.

Figure 5:
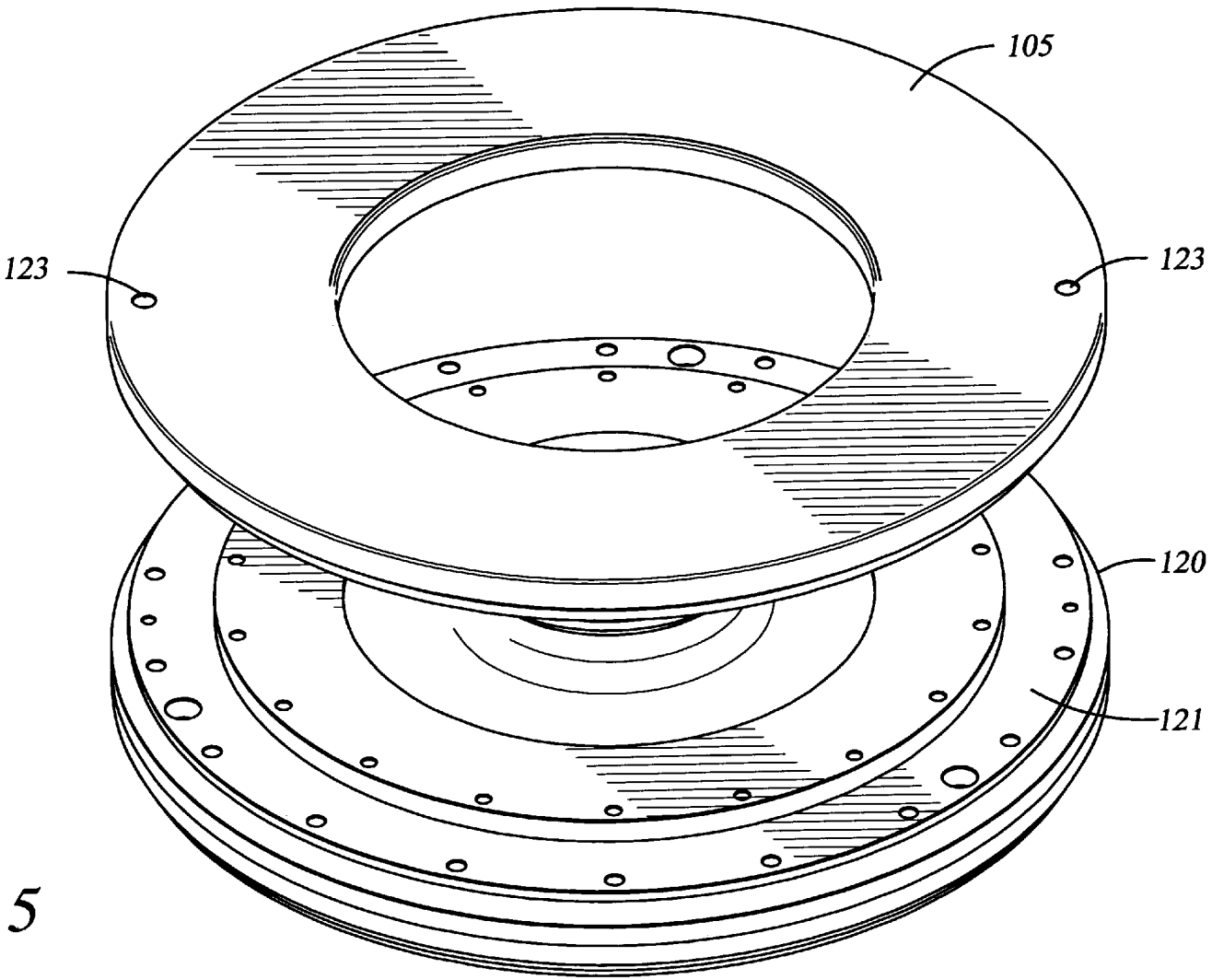
FIG. 5 is a top exploded perspective view of the detachable plate in accordance with an embodiment of the present invention.

The detachable plate 105 may also be easily removed without the assistance of lifting equipment. In one embodiment, the upper surface of the housing plate 120 is shaped so as to conform to the shape of the bottom surface of the detachable plate 105. That is, the housing plate 120 defines a groove 121 (shown in FIG. 5) on its upper surface configured to receive the detachable plate 105. In another embodiment, three high spots are defined on the top surface of the housing plate 120 for seating the detachable plate 105. Two holes 123 are defined on the upper surface of the detachable plate 105 for receiving fastening means. The detachable plate 105 may be attached to the housing plate 120 by various fastening means, such as, bolts. The detachable plate 105 may also be formed of any material that provides weight, such as, stainless steel or tungsten. Alternatively, the detachable plate 105 may be coated with a polymer-type material, such as, Halar™ to prevent metal to metal contact, to avoid slurry adhesion, and to provide high surface lubricity. A top perspective view of the detachable plate 105 is illustrated in FIG. 5.

Referring back to FIG. 4, the housing 102 further includes a generally cylindrical housing hub 122, which defines an upper hub portion 124 and a lower hub portion 126. The housing plate 120 surrounds the lower hub portion 126. Both the housing plate 120 and the housing hub 122 may be formed of stainless steel or aluminum.

The base 104 is a generally ring-shaped body located beneath the housing 102, and more specifically, the housing plate 120. The base 104 may be formed of a rigid material such as aluminum, stainless steel or fiber-reinforced plastic.

The gimbal mechanism 106 permits the base 104 to move with respect to the housing 102 so that the base 104 may remain substantially parallel with the surface of the polishing pad 32. Specifically, the gimbal mechanism 106 permits the base 104 to move vertically, i.e., along the axis of rotation 107, and to pivot, i.e., to rotate about an axis parallel to the surface of the polishing pad 32, with respect to the housing 102. However, the gimbal mechanism 106 prevents the base 104 from moving laterally, i.e., along an axis parallel to the polishing pad 32, with respect to the housing 102. The gimbal mechanism 106 is unloaded; that is, no downward pressure is applied from the housing 102 through the gimbal mechanism 106 to the base 104. However, the gimbal mechanism 106 can transfer any side load, such as the shear force created by the friction between the substrate 10 and polishing pad 32, to the housing 102.

Figure 6:
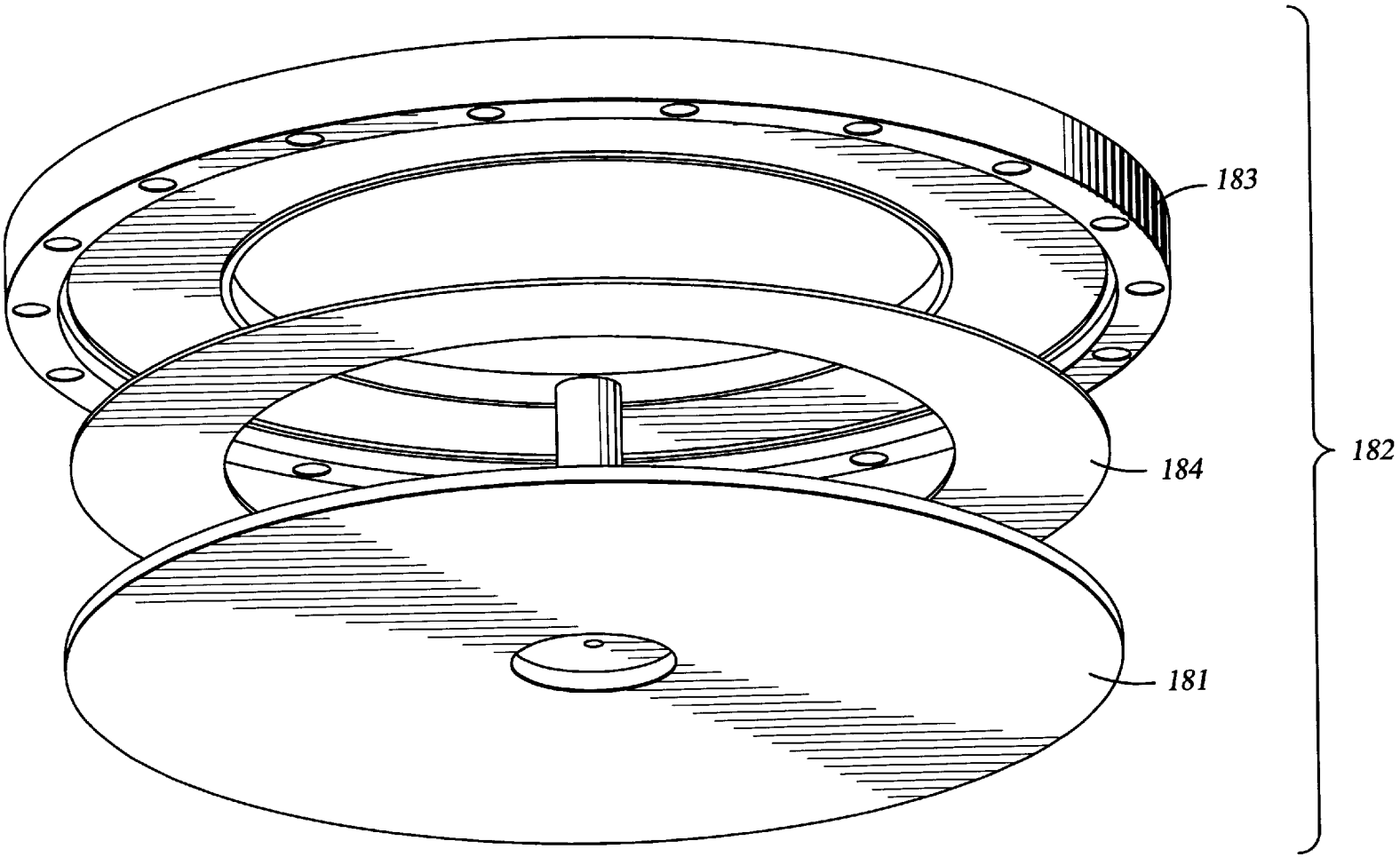
FIG. 6 is an exploded perspective view of the gimbal mechanism in accordance with an embodiment of the present invention.

The gimbal mechanism 106 includes a gimbal rod 180 and a ring 182, which defines an upper gimbal ring portion 183 and a lower gimbal ring portion 181. The upper gimbal ring portion 183 is attached to the housing plate 120 and the lower gimbal ring portion 181. The gimbal rod 180 and the lower gimbal ring portion 181 may be formed of rigid materials, such as stainless steel or aluminum. However, the upper gimbal ring portion 183 may be made of a light material, such as, plastic or fiber-reinforced plastic. Alternately, the upper gimbal ring portion 183 may be formed of a hard plastic, such as DELRIN™, available from Dupont of Wilmington, Del., or of a laminate of glass fibers and epoxy resin, such as G10. In one embodiment, the upper gimbal ring portion 183 is made of a material that reduces the energy created when the CMP system reaches resonance frequency. The gimbal mechanism 106 may further include a dampening ring 184 (shown in FIG. 6) placed in between the upper gimbal ring portion 183 and the lower gimbal ring portion 181. The dampening ring 184 is configured to dampen the high frequency vibrations induced during polishing. In one embodiment, the dampening ring 184 is a rubber gasket. An exploded perspective view of the gimbal mechanism 106 in accordance with an embodiment of the invention is illustrated in FIG. 6. In another aspect, O-rings 198 may be set into recesses in the lower hub portion 126 to provide a seal between the gimbal rod 180 and the lower hub portion 126.

The loading mechanism 108 is positioned between the housing 102 and the base 104 to apply a load, i.e., a downward pressure, to the base 104. In this regard, the vertical position of the base 104 relative to the housing 102 is controlled by the loading mechanism 108. As shown in FIG. 4, the loading mechanism 108 includes a chamber 200 located between the housing 102 and the gimbal 106.

The chamber 200 is formed by sealing the lower hub portion 126 to the housing plate 120. The chamber 200 may be sealed by various means known by one of ordinary skilled in the art. The chamber 200 may be connected to the pump 93*a* (see FIG. 3) via the fluid line 92*a*, the rotary coupling 90, the channel 94*a* in the drive shaft 74, and a passage (not shown) in the housing 102. Fluid or gas, such as air, may be pumped into and out of the chamber 200 to control the load applied to the base 104. If the pump 93*a* pumps fluid into the chamber 200, the volume of the chamber 200 will increase and the base 104 will be pushed downwardly. On the other hand, if the pump 93*a* pumps fluid out of chamber 200, the volume of chamber 200 will decrease and base 104 will be pulled upwardly.

The retaining ring 110 is secured at the outer edge of base 104. The retaining ring 110 is a generally annular ring having a substantially flat bottom surface. When fluid is pumped into the chamber 200 and the base 104 is pushed downwardly, the retaining ring 110 is also pushed downwardly to apply a load to the polishing pad 32. An inner surface 232 of retaining ring 110 defines, in conjunction with mounting surface 274 of flexible membrane 118, a substrate receiving recess 234. The retaining ring 110 prevents the substrate 10 from escaping the receiving recess 234 and transfers the lateral load from the substrate 10 to the base 104. The retaining ring 110 is made of a hard plastic or a ceramic material. In one embodiment, the retaining ring 110 may be secured to the base 104 by, for example, bolts 240 (only one is shown in this cross-sectional view).

The substrate backing assembly 112 is located below the base 104. The substrate backing assembly 112 includes a support structure 114 and a flexible membrane 118. The flexible membrane 118 connects to and extends beneath the support structure 114 to provide a mounting surface 274 for the substrate 10.

The support structure 114 includes a support plate 250, which may be a generally disk-shaped rigid member. The support plate 250 may have a generally planar lower surface 256 and a plurality of apertures 260 extending vertically through the support plate 250 connecting the lower surface 256 to an upper surface 254. The support plate 250 may be formed of aluminum or stainless steel.

As mentioned above, the lower surface of the flexible membrane 118 provides the mounting surface 274 for the substrate 10. During polishing, the substrate 10 is positioned in the substrate receiving recess 234 with the backside of the substrate 10 positioned against the mounting surface 274. In one embodiment, the flexible membrane 118 is a circular sheet formed of a flexible and elastic material, such as a high-strength silicone rubber. The flexible membrane 118 has a protruding outer edge 270 that fits into a groove 262. The edge of flexible membrane 118 is clamped between the base 104 and the housing plate 120. A small aperture or plurality of apertures may be formed at the approximate center of membrane 118 to sense the presence of the substrate. The apertures may be about one to ten millimeters across.

The flexible membrane 118 may adjust to a tilted polishing pad 32 without deforming the portion of the membrane 118 near the edge of the substrate 10. Consequently, the load on the substrate 10 will remain uniform even if the polishing pad 32 is tilted with respect to the carrier head 100. The flexible membrane 118 may also deform to match the backside of substrate 10. For example, if the substrate 10 is warped, the flexible membrane 118 will, in effect, conform to the contours of the warped substrate 10. Thus, the load on the substrate 10 will remain uniform even if there are surface irregularities on the backside of the substrate 10.

While the foregoing is directed to embodiments of the present invention, other and further embodiments of the invention may be devised without departing from the basic scope thereof, and the scope thereof is determined by the claims that follow.

What is claimed is:

1. A carrier head for positioning a substrate on a polishing surface, comprising:

a housing connectable to a drive shaft to rotate therewith;

a base;

a detachable plate removably mounted to the housing;

a gimbal mechanism connecting the housing to the base to permit the base to move with respect to the housing such that the base remains substantially parallel to the polishing surface; and a flexible membrane defining a mounting surface for the substrate.

2. The carrier head of claim 1, wherein the detachable plate is manually removable.

3. The carrier head of claim 1, wherein the detachable plate provides additional weight to the carrier head.

4. The carrier head of claim 1, wherein the gimbal mechanism comprises a dampening ring configured to dampen the vibrations generated while polishing the substrate.

5. The carrier head of claim 1, wherein the gimbal mechanism comprises:

a rod slidably disposed in a vertical passage in the housing; and a ring integrally connected to the rod, the ring defining a lower ring portion and an upper ring portion, the upper ring portion being made of a lighter material than the lower ring portion.

6. The carrier head of claim 1, wherein the gimbal mechanism comprises:

a rod slidably disposed in a vertical passage in the housing;

a ring integrally connected to the rod, the ring defining a lower ring portion and an upper ring portion; and a dampening ring placed in between the lower ring portion and the upper ring portion.

7. The carrier head of claim 1, further comprising a loading mechanism connecting the housing to the base to apply a downward pressure to the base.

8. The carrier head of claim 1, further comprising a retaining ring connected to the base and surrounding the flexible membrane.

9. A carrier head for positioning a substrate on a polishing surface, comprising:

a housing connectable to a drive shaft to rotate therewith;

a base;

a flexible membrane defining a mounting surface for the substrate; and a gimbal mechanism connecting the housing to the base to permit the base to move with respect to the housing such that the base remains substantially parallel to the polishing surface, the gimbal mechanism comprising:

a rod slidably disposed in a vertical passage in the housing; and a ring integrally connected to the rod, the ring defining a lower ring portion and an upper ring portion, the upper ring portion being made of a lighter material than the lower ring portion.

10. The carrier head of claim 9, wherein the gimbal mechanism further comprises a dampening ring configured to dampen the vibrations generated while polishing the substrate.

11. The carrier head of claim 9, wherein the gimbal mechanism further comprises a dampening ring placed in between the lower ring portion and the upper ring portion.

12. The carrier head of claim 9, further comprising a detachable plate removably mounted on the housing.

13. A carrier head for a chemical mechanical polishing apparatus, comprising:

a housing connectable to a drive shaft to rotate therewith;

a loading mechanism connecting the housing to a base to permit vertical movement of the base relative to the housing; and a detachable plate removably mounted on top of the housing.

14. The carrier head of claim 13, wherein the detachable plate is manually removable.

15. The carrier head of claim 13, wherein the detachable plate provides additional weight to the carrier head.

16. The carrier head of claim 13, further comprising a gimbal mechanism having a lower ring portion, an upper ring portion and a dampening ring placed in between the lower ring portion and the upper ring portion.

17. The carrier head of claim 13, wherein the detachable plate is configured to increase the inertia of the carrier head, thereby reducing vibrations that occur during polishing.

18. A carrier head for a chemical mechanical polishing apparatus, comprising:

a housing connectable to a drive shaft to rotate therewith;

a loading mechanism connecting the housing to a base to permit vertical movement of the base relative to the housing;

a detachable plate removably mounted on the housing; and a gimbal mechanism having a dampening ring configured to dampen the vibrations generated while polishing a substrate.

19. A carrier head for a chemical mechanical polishing apparatus, comprising:

a housing connectable to a drive shaft to rotate therewith;

a loading mechanism connecting the housing to a base to permit vertical movement of the base relative to the housing;

a detachable plate removably mounted on the housing;

a gimbal mechanism having a rod slidably disposed in a vertical passage in the housing; and a ring integrally connected to the rod, the ring defining a lower ring portion and an upper ring portion, the upper ring portion being made of a lighter material than the lower ring portion.

20. A carrier head for a chemical mechanical polishing apparatus, comprising:

a housing connectable to a drive shaft to rotate therewith;

a base; and a gimbal mechanism connecting the housing to the base to permit the base to move vertically with respect to the housing, the gimbal mechanism comprising:

a rod slidably disposed in a vertical passage in the housing; and a ring integrally connected to the rod, the ring defining a lower ring portion and an upper ring portion, the upper ring portion being made of a lighter material than the lower ring portion; and a flexible membrane connected to the base, the flexible membrane defining a mounting surface for a substrate.

21. The carrier head of claim 20, wherein the gimbal mechanism further comprises a dampening ring configured to dampen the vibrations generated while polishing the substrate.

22. The carrier head of claim 20, wherein the gimbal mechanism comprises a dampening ring placed in between the lower ring portion and the upper ring portion.

23. The carrier head of claim 20, further comprising a detachable plate removably mounted to the housing.

* * * * *